US005258595A

United States Patent [19]

Tanaka

[11] Patent Number: 5,258,595

[45] Date of Patent: Nov. 2, 1993

[54] POWER SOURCE CIRCUIT FOR MICROWAVE OVEN

[75] Inventor: Hideo Tanaka, Aichi, Japan

[73] Assignee: Kabushiki Kaisha Toshiba, Kawasaki, Japan

[21] Appl. No.: 674,392

[22] Filed: Mar. 25, 1991

[30] Foreign Application Priority Data

Mar. 30, 1990 [JP] Japan ..... 2-85728

[51] Int. Cl.[5] ..... H05B 6/68

[52] U.S. Cl. ..... 219/10.55 C

[58] Field of Search ..... 219/10.55 C, 10.55 B, 219/10.55 D; 200/50 C

[56] References Cited

U.S. PATENT DOCUMENTS 3,746,938 7/1973 Lamb ..... 219/10.55 C
4,117,294 9/1978 Appelquist et al. ..... 219/10.55 C
4,278,862 7/1981 Mizuno et al. ..... 219/10.55 C
4,323,747 4/1982 Takase et al. ..... 219/10.55 C
4,461,940 7/1984 Ishimura ..... 219/10.55 C
4,542,269 9/1985 Sakoda ..... 219/10.55 C

*Primary Examiner*—Philip H. Leung
*Attorney, Agent, or Firm*—Foley & Lardner

[57] ABSTRACT

A power source circuit for a microwave oven is provided with first and second door switches that are opened by opening the door of the microwave heating chamber and a third door switch having a movable contact that is converted to first and second fixed contacts in response to closing and opening the door respectively. The circuit insures safe cut off of the microwave magnetron even if the first door switch does not open upon opening the door and also in the event of grounding of the primary of a high voltage transformer.

8 Claims, 4 Drawing Sheets

FIG.3(a)
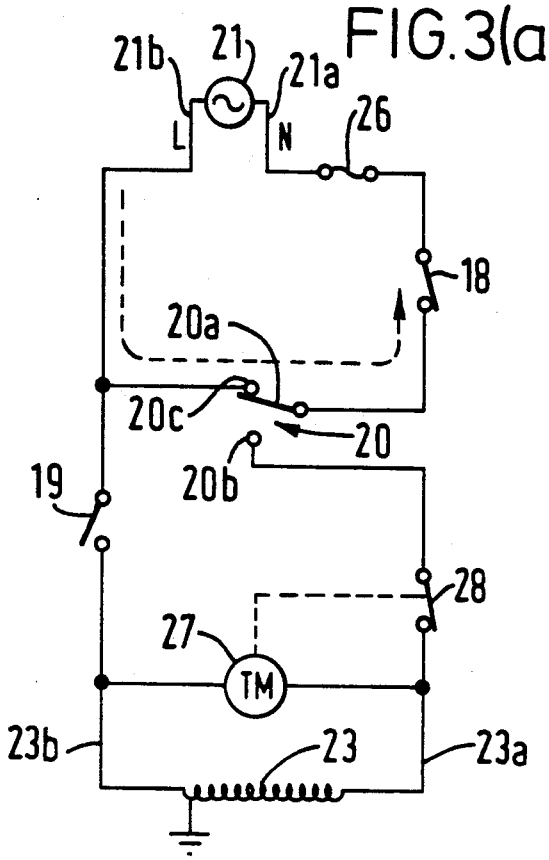
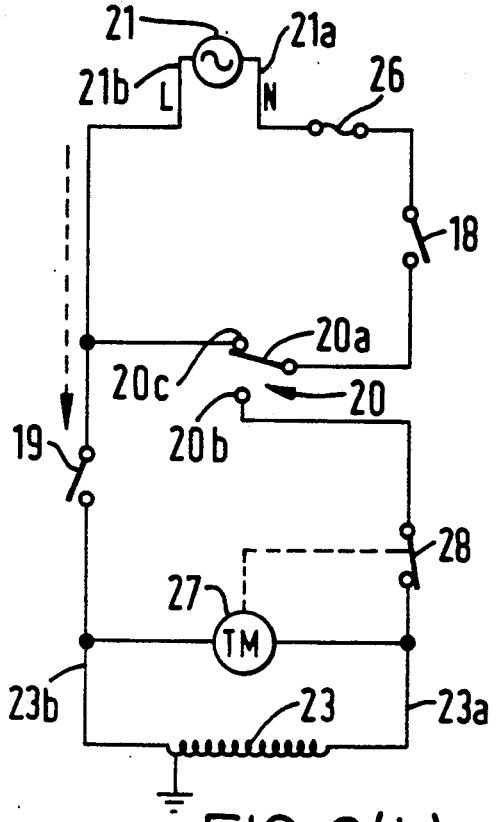
FIG.3(b)
FIG. 4
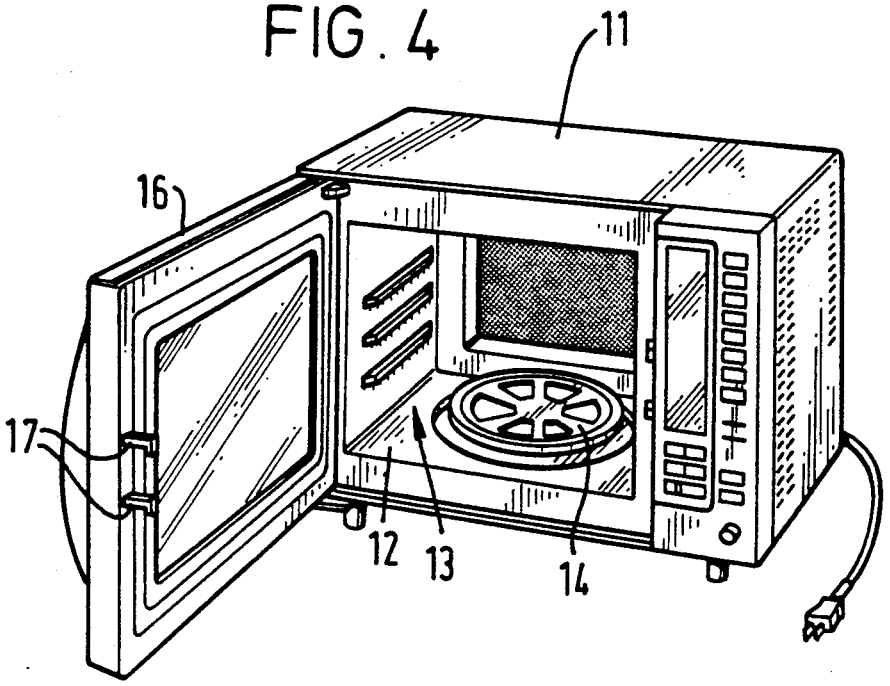

POWER SOURCE CIRCUIT FOR MICROWAVE OVEN

BACKGROUND OF THE INVENTION

Field of the Invention

The present invention relates, in general, to a power source circuit for a microwave oven. In particular, the invention relates to a power source circuit incorporated on the primary side of a high voltage transformer.

Description of the Related Art

In general, in a power source circuit for a magnetron of a microwave oven, the primary side of a high voltage transformer is connected to the main power source. A high voltage rectifier circuit is provided on the secondary side, and the D.C. output of the high voltage rectifier is applied to the magnetron. In this case, usually the circuit on the primary side of the high voltage transformer is constructed so as to prevent the magnetron from oscillating while the door of the heating chamber is open.

For example, FIG. 5 shows the conventional technique. In FIG. 5, normally when the door of the heating chamber is opened, the primary winding of high voltage transformer 22 is isolated from the main power source 21 by opening first and second door switches 18 and 19. Also, a third door switch 30 is closed when the door is opened. So even if, due to some malfunction such as welding of the contacts of door switch 18, the contacts of switch 18 should fail to open when the door is opened, a safe condition is ensured by the immediate melting of fuse 26, due to the formation of a short circuit of the main power source 21 through the closed switch 30 as shown by the broken line in FIG. 6.

However, the above construction is still subject to the problem that if there should be some failure in the insulation of the high voltage transformer 22, a safe condition would not be guaranteed when the door is opened. Thus, if the bus on the side of the second door switch 19 of the pair of buses from the main power source 21 is live, (i.e., is the non-grounded side in the power transmission system), and if the primary winding of high voltage transformer 22 is grounded by failure of insulation etc. then when third door switch 30 is closed by opening the door while the timer switch 31 is closed, a path will be formed as shown by the broken line in FIG. 7. If a current flows through this path, there is a possibility that the oscillating condition of the magnetron 15 will be maintained even after the door is opened. In this case, if the house is equipped with a ground leakage circuit breaker, the power source will be cut off by operation of the ground leakage circuit breaker. But the existence of the possibility of such oscillation of the magnetron 15 is itself very undesirable from the safety point of view.

To deal with this risk, it would be possible to provide two door switches 18 and 32 which open with opening of the door on both buses of the main power source 21 as shown in FIG. 8. However, with such a construction, it is possible for fuse 26 to melt only after both two switches 18 and 19 have welded, and thus this construction is still worse from the point of view of safety.

SUMMARY OF THE INVENTION

Accordingly, it is an object of the present invention to provide a power source circuit for a microwave oven wherein safety can be improved by reliably preventing the magnetron from oscillating when the door is open even if there is some failure of insulation of the high voltage transformer.

In accordance with the present invention, there is provided a power source circuit for a microwave oven which includes a first and second bus, a high voltage transformer and first, second and third door switches. The first and second buses are connected to a power source. The high voltage transformer has a primary winding with first and second ends connected to the first and second buses respectively. The first door switch is connected between the first bus and the first end of the primary winding and is opened in response to opening of a door of the microwave oven. Likewise, the second door switch is connected between the second bus and the second end of the primary winding and is opened by opening of the microwave oven door. The third door switch has a movable contact and a first and second fixed contact. The movable contact makes electrical contact with the first fixed contact in response to closure of the door and contacts the second fixed contact in response to opening of the door. The movable contact and the first fixed contact are connected together and connected between the first switch and the first end of the primary winding when the door is closed. Further, the movable contact and the second fixed contact are connected together and connected between the first switch and the second bus when the door is opened.

BRIEF DESCRIPTION OF THE DRAWINGS

These and other objects and advantages of this invention will become more apparent from the following detailed description of the presently preferred embodiment of the invention, taken in conjunction with the accompanying drawings of which:

FIG. 3(*a*) is a partial circuit diagram showing the condition when contact welding has occurred in the first door switch shown in FIG. 1;

FIG. 3(*b*) is a partial circuit diagram showing the condition when some failure of insulation has occurred in the high voltage transformer shown in FIG. 1;

FIG. 4 is a perspective view of a microwave oven;

DETAILED DESCRIPTION OF THE PREFERRED EMBODIMENTS

Figure 1:
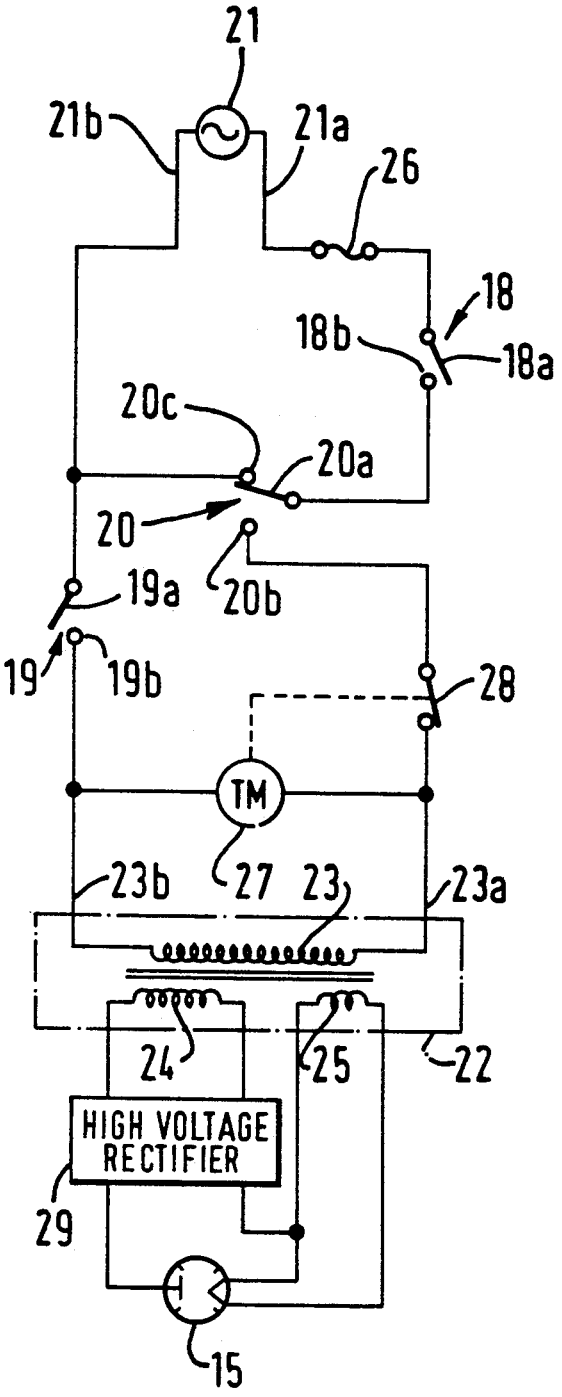
FIG. 1 is a circuit diagram showing the condition with the door open in an embodiment of this invention.

The preferred embodiment of the present invention will now be described in more detail with reference to the accompanying drawings. Like reference numerals designate like or corresponding parts throughout the drawings.

As shown by the overall external view of FIG. 4, an inner box 12 is accommodated in an outer box 11. A front face of the inner box 12 can be opened so that an interior of the inner box 12 can be used as a heating chamber 13. At the bottom of the heating chamber 13, a turntable 14 is provided. The food is placed on the turntable 14. The microwaves emitted from a magnetron 15 (FIG. 1), to be described, are guided into the heating chamber 13. The front face of the heating chamber 13 can be opened and closed by means of a door 16 that is pivoted to the outer box 11. Two engagement claws 17 for locking the door 16 in a closed condition are provided projecting from the side edge opposite to the pivoted side of the door 16.

The electrical layout will now be described in reference to FIGS. 1 and 2. A total of three door switches 18, 19 and 20 are provided in outer box 11. These switches are actuated in a manner linked to the opening and closing of the door 16. The first and second door switches 18 and 19 are of the single-throw type having a pair of movable contacts 18*a* and 19*a* and a pair of fixed contacts 18*b* and 19*b*. The construction is such that when the door 16 of the heating chamber 13 is closed, the two engagement claws 17 of the door 16 press on actuators (not shown), closing contact pairs 18*a*, 18*b* and 19*a*, 19*b*. But when the door 16 is opened, the engagement claws 17 separate from the actuators with the result that these contact pairs are opened. In contrast, third door switch 20 is of double-throw type having a movable contact 20*a* and first and second fixed contacts 20*b* and 20*c*. The connection condition of the contacts of the third door switch 20 is changed over by an actuator (not shown) being pressed by the door 16. That is, when the door 16 of the heating chamber 13 is closed, the door 16 presses on the actuator, bringing movable contact 20*a* into contact with first fixed contact 20*b*. When the door 16 is opened, the actuator moves movable contact 20*a* into the condition contacting the second fixed contact 20*c*.

On a high voltage transformer 22 for supplying power to a magnetron 15 from main power source 21, there are wound a primary winding 23, a secondary winding 24 for high voltage use, and a tertiary winding 25 for the heater of the magnetron 15. A timer motor 27 is connected in parallel with primary winding 23 of the high voltage transformer 22. A timer switch 28 that is opened and closed by the timer motor 27 is connected to one lead wire 23*a* of the primary winding 23 of the high voltage transformer 22. Between one of the buses 21*a* of the main power source 21 and the timer switch 28, there are arranged, connected in series, a fuse 26, the first door switch 18 and the movable contact 20*a* and first fixed contact 20*b* of third door switch 20. Also, between the other bus 21*b* of main power source 21 the other lead wire 23*b* of the primary winding 23 of the high voltage transformer 22, the second door switch 19 is connected in series. Furthermore, second fixed contact 20*c* of the third door switch 20 is connected to the other bus 21*b* of main power source 21. The secondary winding 24 of the high voltage transformer 22 is connected between the plate and cathode of the magnetron 15 through a high voltage rectifier circuit 29, while the tertiary winding 25 is connected to the heater of the magnetron 15.

Figure 2:
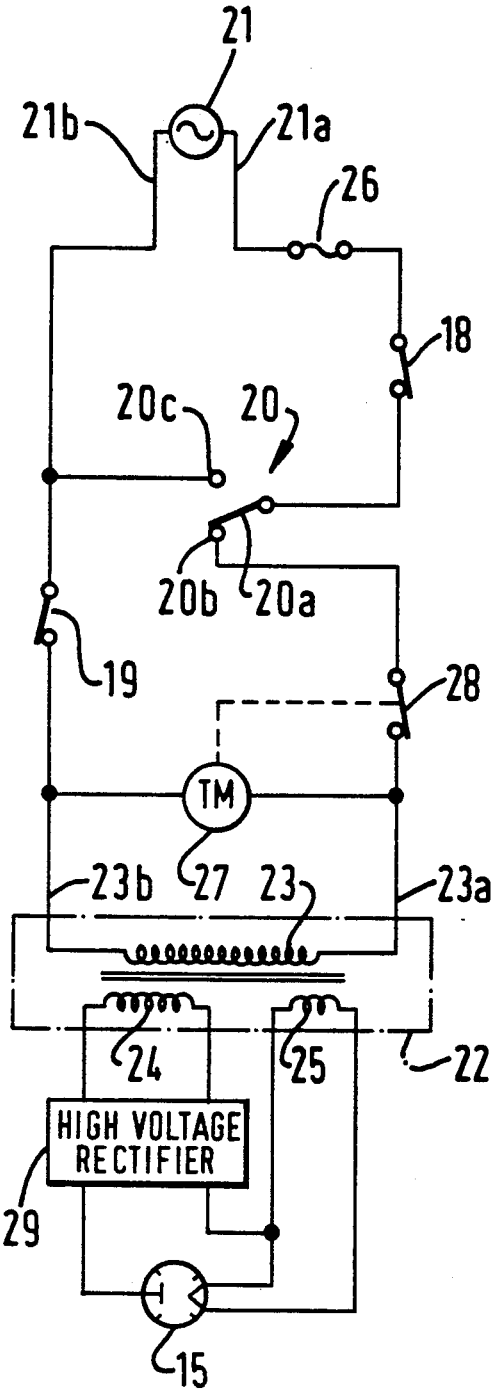
FIG. 2 is a circuit diagram showing the condition with the door closed in an embodiment of this invention.
Figure 5:
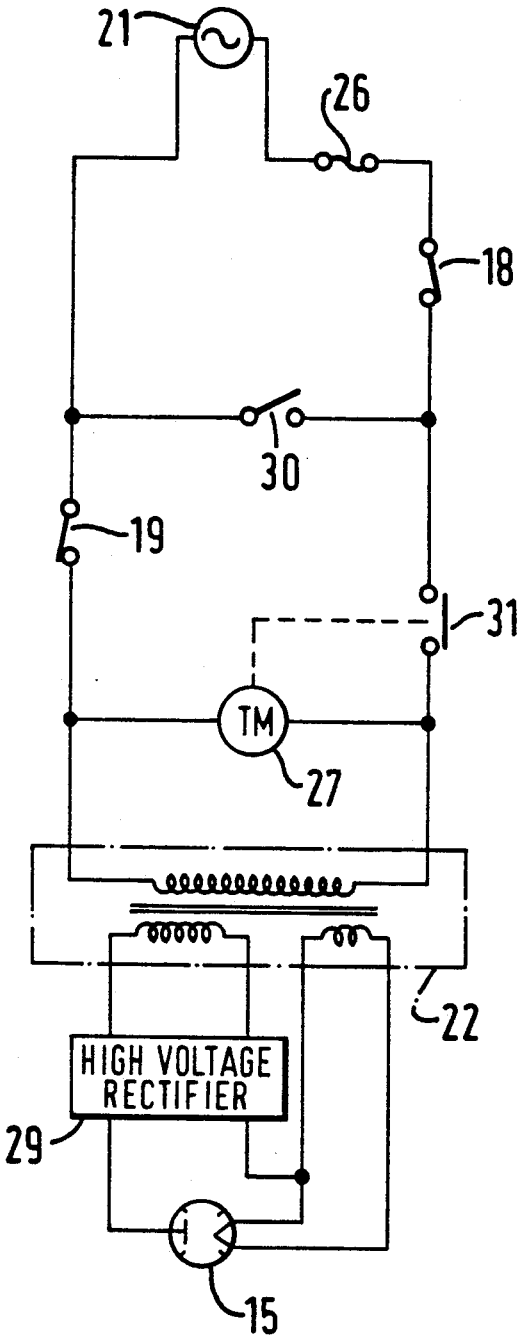
FIG. 5 PRIOR ART
FIG. 5 is a circuit diagram of a conventional power source circuit for a microwave oven.
Figure 6:
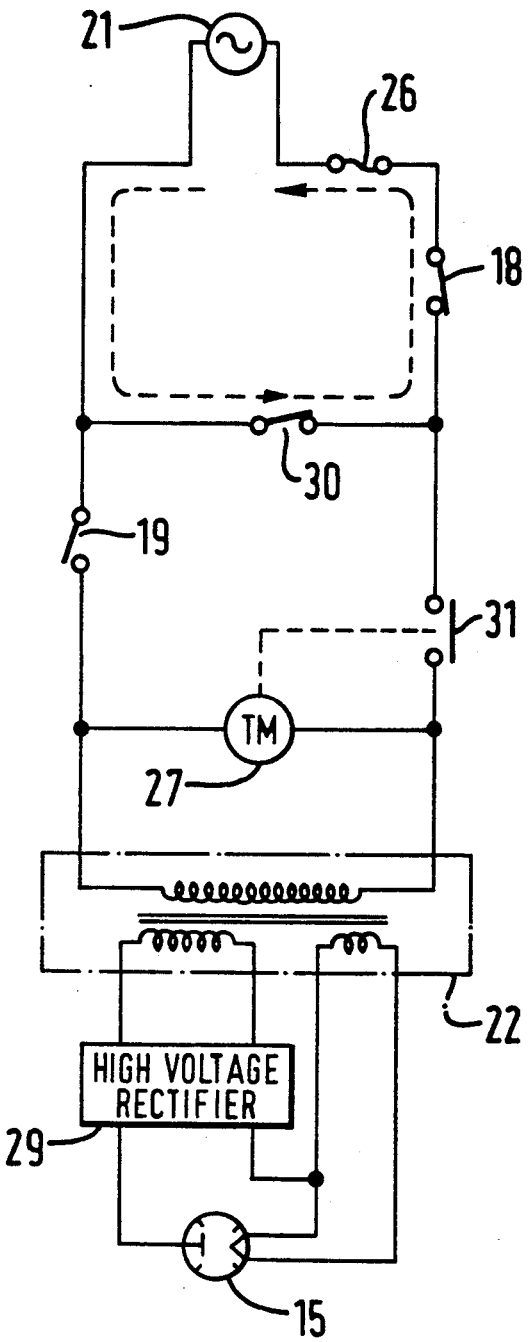
FIG. 6 PRIOR ART
FIG. 6 is a circuit diagram showing the condition when a short circuit of the main power source is formed in FIG. 5.

In operation, when the food that is to be heated is placed inside heating chamber 13 and the door 16 is closed, as shown in FIG. 2, the first and second door switches 18 and 19 are closed. The movable contact 20*a* of the third door switch 20 is put in contact with first fixed contact 20*b*. Thereupon, when the desired time is set by turning timer switch 28 ON, a current is passed to the timer motor 27 and the primary winding 23 of the high voltage transformer 22, thereby causing magnetron 15 to oscillate and the food in the heating chamber 13 to be irradiated with microwaves. When the set time has elapsed, the timer switch 28 is opened by the rotation of the timer motor 27, causing the magnetron 15 to stop oscillating and cooking to be terminated.

Assume now that the door 16 is opened when the timer switch 28 is closed before the set time has elapsed. Under ordinary conditions, when the first door switch 18 and the second door switch 19 are functioning normally, the two switches 18 and 19 are opened by the opening of the door 16 of the heating chamber 13. The primary winding 23 of the high voltage transformer 22 is isolated from the main power source 21, cutting off the supply of power to the magnetron 15. Thus, the situation of microwaves being discharged to the outside from the heating chamber 13 whose door 16 has been opened can be reliably prevented.

Consider now the exceptional case where, even though the door 16 is opened, the contacts 18*a*, 18*b* of the first door switch 18 function abnormally and do not open, due for example to contact welding between contacts 18*a* and 18*b*. However, in this embodiment of the invention, on opening the door 16, the connection condition of movable contact 20*a* and second fixed contact 20*c* of the third door switch 20 is always changed over. In this case, as shown in FIG. 3(*a*), the primary winding 23 of the high voltage transformer 22 is isolated from the main power source 21 and a short circuit of the main power source 21 is formed through a fuse 26, the first door switch 18 and the third door switch 20. Thus, the oscillation of the magnetron 15 will still be stopped, so the situation of microwaves being discharged from the heating chamber 13 to the outside can be reliably prevented. The abnormal condition is made obvious by melting of the fuse 26.

Figure 7:
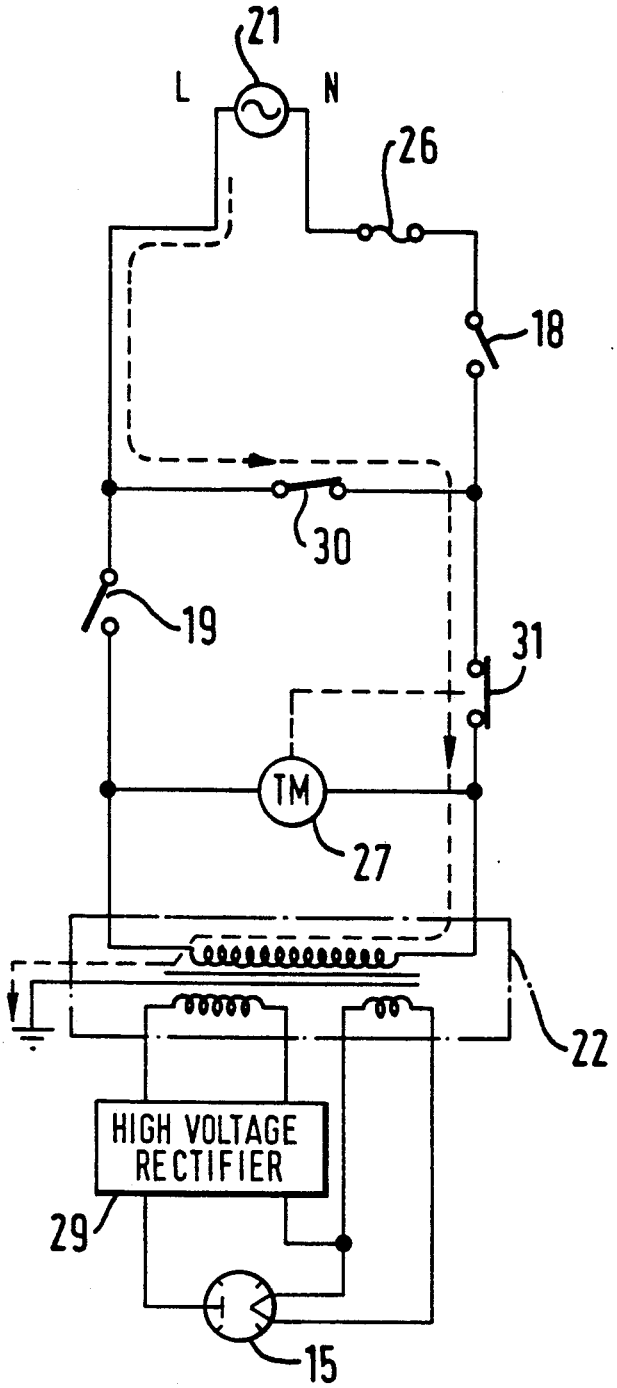
FIG. 7 PRIOR ART
FIG. 7 is a circuit diagram showing the condition when the primary winding of high voltage transformer is earthed in FIG. 5.
Figure 8:
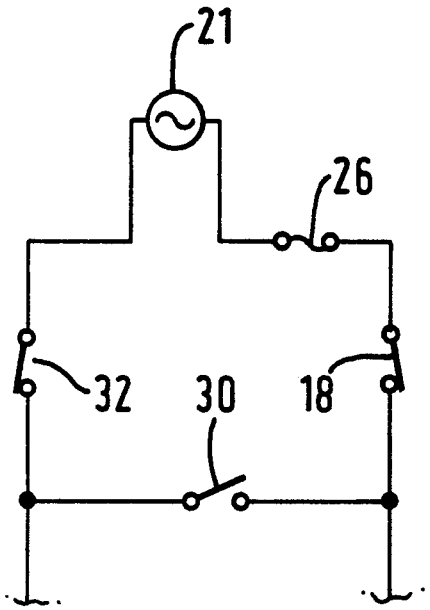
FIG. 8 PRIOR ART
FIG. 8 is a partial circuit diagram showing an example of conventional countermeasures.

Furthermore, considering the case where, of the pair of buses 21*a*, 21*b* of the main power source 21, the bus 21*b* on the side of second door switch 19 is live and some failure of insulation etc. of the high voltage transformer 22 has allowed the other lead wire 23*b* of the primary winding 23 to become grounded. Conventionally, this would have resulted in a condition in which power could be supplied to the magnetron 15 (see FIG. 7). However, in the present embodiment, in such a case, opening of the door 16 changes over the movable contact 20*a* of the third door switch 20 from the condition contacting the first fixed contact 20*b*to a condition contacting the second fixed contact 20*c*. Thus, the primary winding 23 of the high voltage transformer 22 is isolated from the main power source 21 (see FIG. 3(*b*)). As a result, the magnetron 15 will still be prevented from oscillating and a situation in which the microwaves are discharged to the outside from the heating chamber 13 can be reliably prevented.

As described above, with this embodiment, even when the contacts fail to open with opening of the door 16 due to malfunction of a door switch, the oscillation of the magnetron 15 can be prevented by isolating primary winding 23 of the high voltage transformer 22 from the main power source 21 by melting of the fuse 26 etc. Also, even if insulation breakdown of the high voltage transformer 22 should occur, the situation of the magnetron 15 oscillating can be reliably prevented in accordance with the polarity of the main power source. Consequently, in such a case also, user safety can be fully guaranteed without waiting for the domestic ground leakage circuit breaker to operate.

Numerous other modifications and variations of the present invention are possible in light of the above teachings. It is therefore to be understood that, within the scope of the appended claims, the present invention can be practiced in a manner other than as specifically described herein.

What is claimed is:

1. A power source circuit for a microwave oven comprising:

a) first and second buses connected to a power source;

b) a high voltage transformer having a primary winding, said primary winding having first and second ends connected to said first and second buses respectively;

c) a first door switch connected between said first bus and said first end of said primary winding, said first switch being opened by opening of a door of said microwave oven;

d) a second door switch connected between said second bus and said second end of said primary winding, said second switch being opened by opening of said door of said microwave oven; and e) a third door switch having a movable contact and first and second fixed contacts, said movable contact contacting said first fixed contact in response to closure of said door and contacting said second fixed contact in response to opening of said door;

f) wherein said movable contract and said first fixed contact are connected together to form a connection between said first switch and said first end of said primary winding when said door is closed; and g) said movable contact and said second fixed contact are connected together to form a connection between said first switch and said second bus when said door is opened.

2. A power source circuit as recited in claim 1, wherein said first door switch comprises a movable contact and a fixed contact.

3. A power source circuit as recited in claim 1, wherein said second door switch comprises a movable contact and a fixed contact.

4. A power source circuit as recited in claim 1, wherein said transformer includes a secondary winding for high voltage use in operating a magnetron of said microwave oven and a tertiary winding for a heater of said magnetron.

5. A power source circuit as recited in claim 4, further including a timer motor connected in parallel with said primary winding of said high voltage transformer.

6. A power source circuit as recited in claim 5, further including a timer switch opened and closed in response to said timer motor, said timer switch connected to one end of said primary winding and to one of said first and second buses.

7. A power source circuit as recited in claim 1, further including a high voltage rectifier circuit connected between said magnetron and said secondary winding.

8. A power source circuit as recited in claim 1, further including a fuse connected in series between said first switch and said first bus.

* * * * *